US005215379A

United States Patent [19]

Pickard et al.

[11] Patent Number: 5,215,379

[45] Date of Patent: Jun. 1, 1993

[54] INFORMATION STORAGE ENVELOPE

[75] Inventors: Barbara L. Pickard, Maple Grove; Betty J. Foster, Minneapolis, both of Minn.

[73] Assignee: Foster - Pickard International Inc., Minneapolis, Minn.

[21] Appl. No.: 805,552

[22] Filed: Dec. 10, 1991

[51] Int. Cl.[5] ..... B65D 33/14

[52] U.S. Cl. ..... 383/37; 383/40; 383/106; 383/6; 224/222

[58] Field of Search ..... 383/37, 38, 39, 40, 383/6, 106; 224/222, 227, 228, 229; 40/606, 607; 229/71

[56] References Cited

U.S. PATENT DOCUMENTS

| | | | |
|---|---|---|---|
| 597,325 | 1/1898 | Prickett | 383/106 X |
| 781,056 | 1/1905 | Duncan | 224/222 |
| 1,416,238 | 5/1922 | Seiler | 383/38 |
| 1,418,403 | 6/1922 | Smith | 383/38 |
| 1,728,365 | 9/1929 | Root et al. | 224/222 |
| 1,738,802 | 12/1929 | Stanley | 383/40 X |
| 2,980,315 | 4/1961 | Miner | 229/303 |
| 3,151,649 | 10/1964 | Mitchell, Jr. | 383/40 X |

FOREIGN PATENT DOCUMENTS

| | | | |
|---|---|---|---|
| 2014315 | 10/1971 | Fed. Rep. of Germany | 224/222 |
| 191321 | 1/1923 | United Kingdom | 224/222 |

OTHER PUBLICATIONS

Superior Real Estate Brochure, believed to be published in 1991, pp. 15–16 show the current state of the art in real estate information boxes.

*Primary Examiner*—Allan N. Shoap
*Assistant Examiner*—Jes F. Pascua
*Attorney, Agent, or Firm*—Leone & Moffa

[57] ABSTRACT

An information storage envelope for holding literature and mounting onto a sign post includes a first pocket which has an open top and a drainage mechanism. The first pocket includes indicia silkscreened thereon. A second smaller pocket has an open top and is attached to the first pocket. First and second straps are attached to the first pocket and each strap has first and second ends wherein the first and second ends include mating fastening elements. The straps are attached to the first pocket so as to allow fastening of the straps and pocket snugly about a post. A flap is attached to the top of the first pocket so as to provide closure for the openings of the first and second pockets. The flap also includes first and second mating flap fastening elements where the first fastening element is attached to the inside of the flap and the second mating fastening element is attached to the second smaller pocket and located so as to be aligned with the first fastening element when the flap is closed. The flap is attached to the top of the first pocket so as to gravitationally self close when the information storage envelope is mounted onto a post. A window is attached to the flap wherein the first and second pockets, the flap, and the at least first and second straps are comprised of a weather resistant material.

18 Claims, 5 Drawing Sheets

INFORMATION STORAGE ENVELOPE

FIELD OF THE INVENTION

The invention is directed generally to structures used for the dissemination of printed material relative to sales at the point of sale, e.g. the sale of real estate, and more particularly to an envelope which is made of lightweight flexible material and which can be affixed to a sign post without the use of tools.

DISCUSSION OF PRIOR ART

Currently available self service units are typically made of hard molded materials. The size, rigidity and weight of existing units makes them relatively awkward to install, use and store. Current devices are usually attached to the upper surface of the horizontal portion of square wooden sign posts. Attachment of these devices is usually difficult because of the height of the posts used by various companies especially real estate companies.

Prior art devices generally require the use of tools because the methods of attachment are via screws, bolts or similar devices. Typically, supplied screws are designed as "self-tapping", meaning they do not require pre-drilled holes in wooden sign posts. Consequently, metal and plastic sign posts, as presently marketed, would require drilled holes and thus do not easily lend themselves to the use of prior art designs.

Prior art devices are limited in their use relative to specific shapes of sign posts. They are individually designed for a specific post shape and do not accommodate other shapes.

Current devices typically do not have a separate, weather resistant business card compartment available to those seeking additional information and, consequently do not provide for personalization of the item.

In contrast to prior art, the present invention provides a design which is more versatile in several ways. The item is light in weight, soft, flexible, and is comparatively flat in shape; consequently, it is easy to handle, install and store. Furthermore, an envelope of the present invention can be carried in a briefcase and used at sale or listing presentations. The envelope of the present invention is designed to attach to the vertical rather than the horizontal portion of a sign post and can be easily attached in a variety of positions (high or low) to accommodate the height of a person or the sign post itself. A fastening material such as Velcro TM affixed to the ends of polypropylene straps is the primary method of attachment. Plastic ties are provided so that the straps cannot be easily loosened by vandals. No tools are required in the attachment of this device to wooden, metal or plastic sign posts. The devices can be mounted on either square or round posts thus accommodating a variety of sign post designs and composition (for example, wood, plastic, metal, etc.).

SUMMARY OF THE INVENTION

In contrast to the prior art the present invention provides an information storage envelope for holding literature and mounting onto a sign post. A first pocket has an open top and a drainage mechanism. The first pocket includes indicia silkscreened thereon. A second smaller pocket has an open top and is attached to the first pocket. First and second straps are attached to the first pocket and each strap has first and second ends wherein the first and second ends include mating fastening elements. The straps are attached to the first pocket so as to allow fastening of the straps and pocket snugly about a post. A flap is attached to the top of the first pocket so as to provide closure for the openings of the first and second pockets. The flap also includes first and second mating flap fastening elements where the first fastening element is attached to the inside of the flap and the second mating fastening element is attached to the second smaller pocket and located so as to be aligned with the first fastening element when the flap is closed. The flap is attached to the top of the first pocket so as to gravitationally self close when the information storage envelope is mounted onto a post. A window is attached to the flap wherein the first and second pockets, the flap, and the at least first and second straps are comprised of a weather resistant material.

In one aspect of the invention a theft deterrent means includes holes located through the ends of the at least first and second straps wherein the holes are aligned so as to allow insertion of a locking device.

In another aspect of the invention a first removable bag is inserted into the first pocket for storing literature and a second removable bag is inserted into the second pocket for storing cards.

In yet another aspect of the invention the first and second pockets and the flap are comprised of vinyl, most advantageously a marine grade vinyl, and the straps are comprised of polypropylene material.

It is one object of the invention to provide a storage envelope having a business card window for individual or company personalization of the invention.

It is another object of the invention to provide a storage envelope having a pocket for storing a quantity of business cards.

It is another object of the invention to provide a storage envelope having an easy means of attachment (e.g. straps with Velcro TM to a variety of shapes and materials used in the manufacture of sign posts, most especially those used by real estate companies and building contractors.

It is yet another object of the invention to provide a model that is easy to transport, store and handle because it is made of soft flexible material and it is of a design which can be easily carried in a briefcase.

It is another object of the invention to provide a model which is weather resistant and can be mounted without the use of tools.

It is yet another object of the invention to provide a storage envelope having an optional theft deterrent device.

It is yet another object to provide models in a range of colors which are compatible with and complimentary to colors used to identify various companies.

DESCRIPTION OF THE PREFERRED EMBODIMENT

Figure 1:
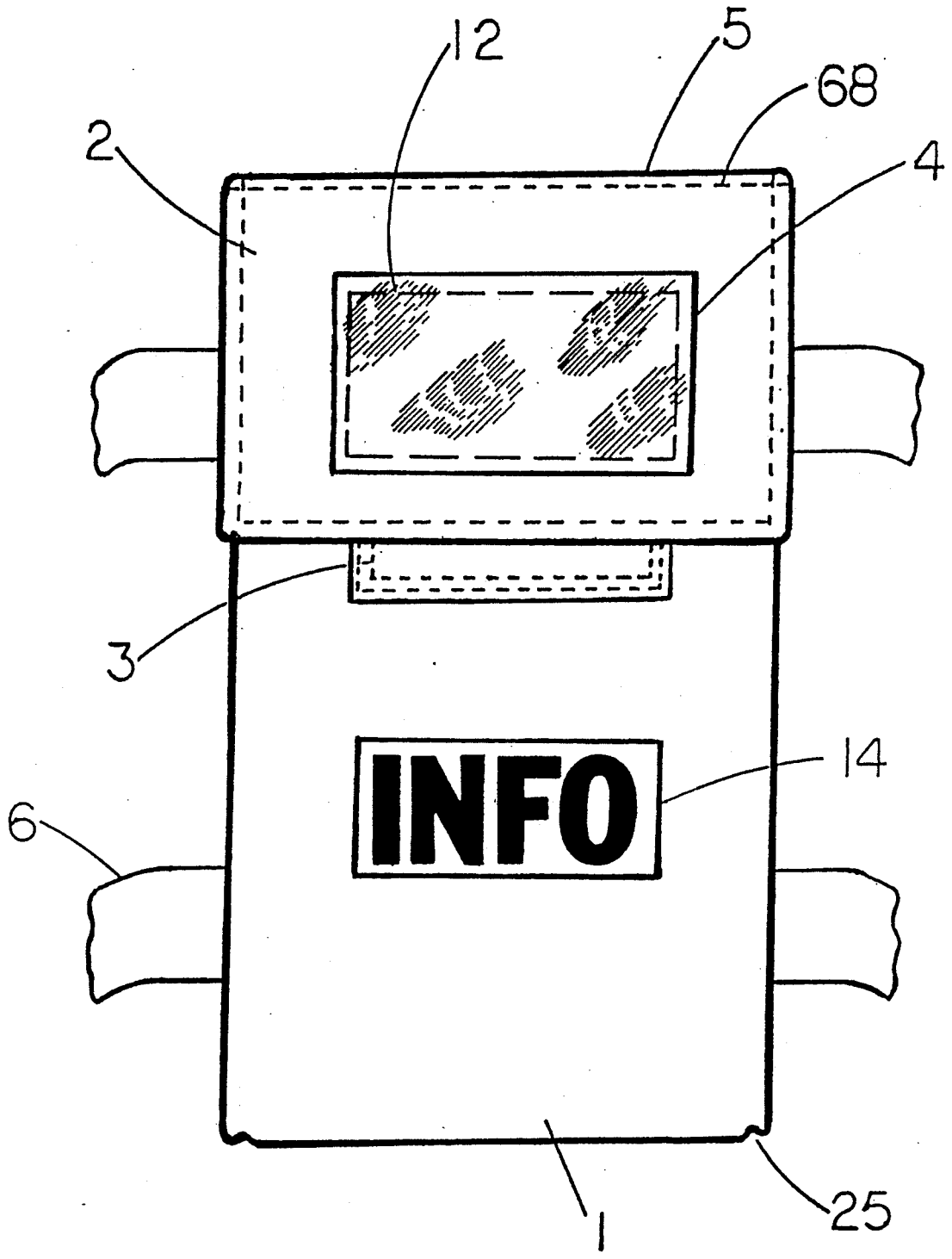
FIG. 1 shows schematically a front view of one example of the invention employing a business card window, a closure flap with a self-closing hinge and portions of a literature pocket, business card pocket and straps.

Referring now to FIG. 1, a front view of one example of the envelope 1 of the invention employing a business card window 4, a closure flap 2, a self-closing hinge 5, and a portion of a business card pocket 3 is shown. Also shown are portions of top and bottom straps 6 which are affixed to envelope 1. For purposes of illustrating its use, a business card 12 is shown inserted into the window 4. Indicia 14 may be advantageously silk screened or otherwise printed upon the front of the envelope 1.

Figure 2:
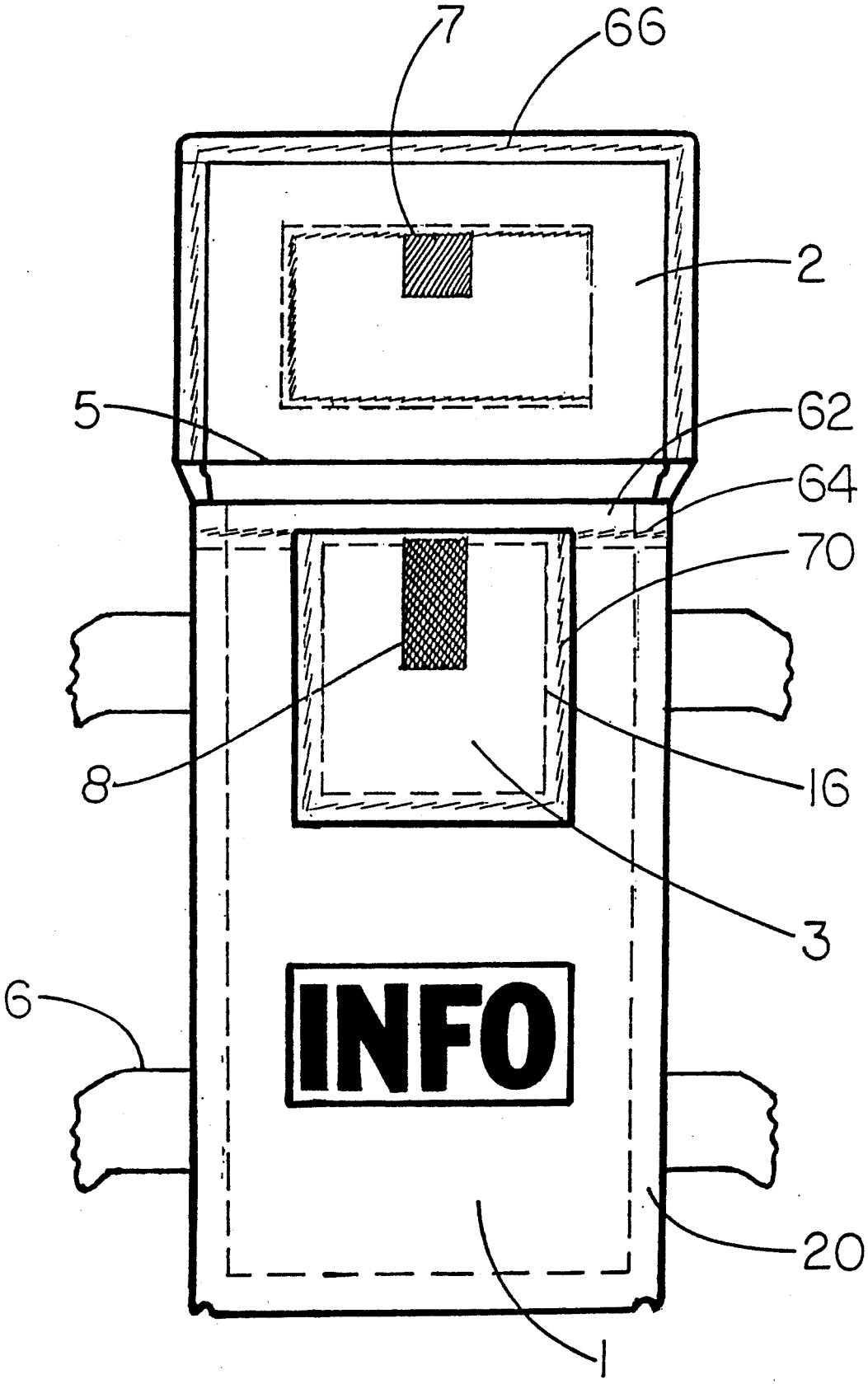
FIG. 2 shows another front view of one example of the invention wherein the closure flap is raised revealing the relative positions of complimentary velcro pieces which secure the closure flap when mated and full views of literature and business card pockets.

Referring now to FIG. 2, another view of the envelope 1 of the invention is shown wherein the closure flap 2 has been opened to fully reveal the business card pocket 3. The business card pocket 3 further may advantageously include a plastic insertable pocket 16 wherein a number of business cards, for example, may be stored. A larger insertable pocket indicated by dotted lines 18 may be inserted in the main body of the envelope 1 for storing advertising sheets, for example. The first pocket 16 and the second pocket 18 are both preferably removable and may be preloaded with advertising materials before inserting into their respective pockets 3, 20. Also shown are first and second mating fastening pieces 7 and 8 which are preferably made of complimentary hook and loop materials such as Velcro TM or another equivalent fastener. The first mating piece 8 is a strip which is preferably located on the business card pocket 3 with the second mating piece 7 being located on the underside of flap 2.

Figure 3:
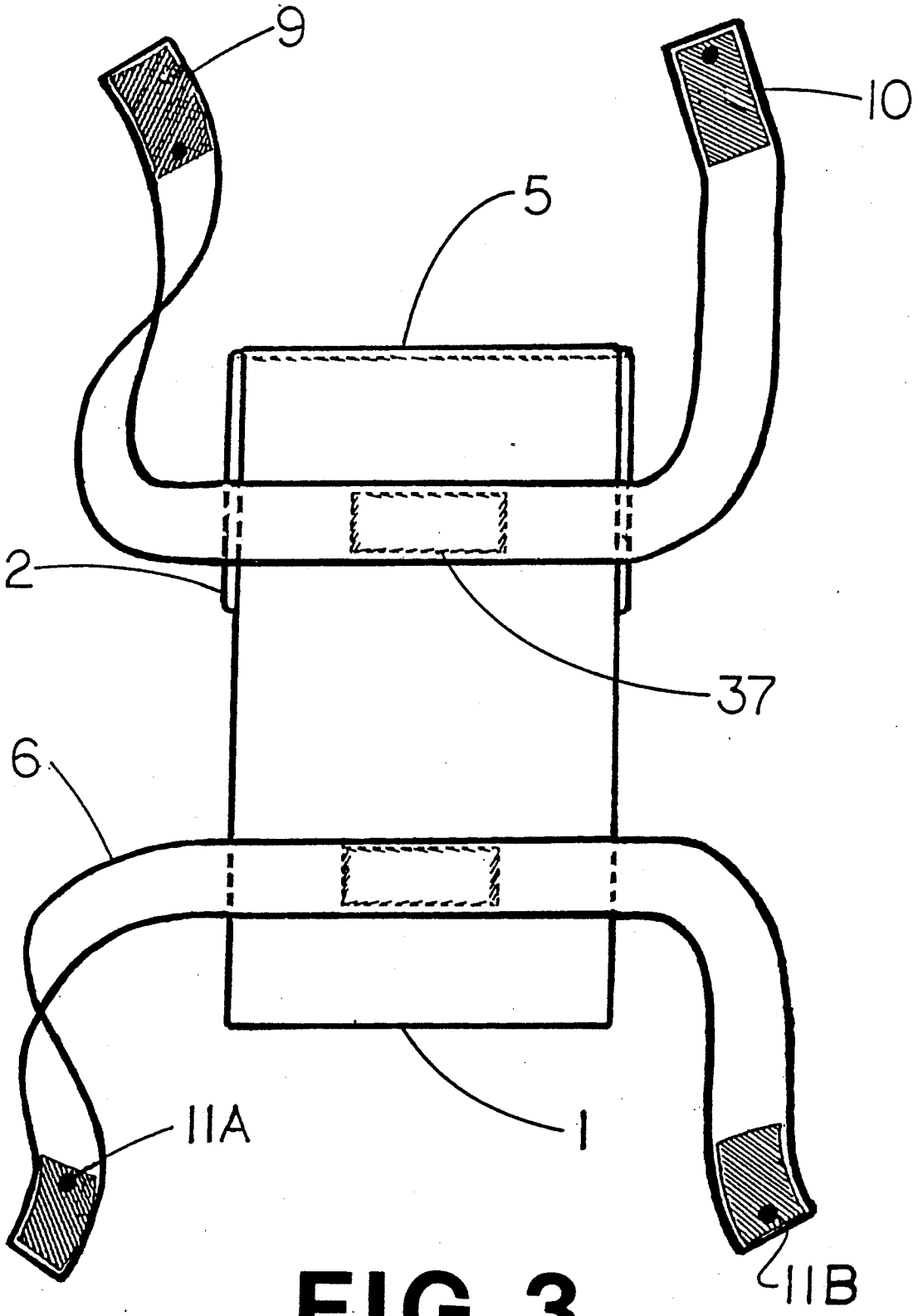
FIG. 3 shows a back view of one example of the invention illustrating the positioning of the attachment straps to the body of the invention, the position of mating velcro pieces on the straps and eyelets which are used with an optional anti-theft device, for example a plastic cable tie.

Now referring to FIG. 3, the back side of the envelope 1 is shown. Here the straps 6 include a first upper strap and a lower strap. Each of the straps have mating fastening pieces which are also advantageously made of a velcro-type material. The straps 6 are advantageously comprised of an ultraviolet resistant polypropylene or equivalent material. Holes 11A and 11B ar hot-punched into each of the mating pieces 9 and 10 to be aligned for subsequent insertion of the theft deterrent device as shown in FIG. 4 and explained in more detail below.

Figure 4:
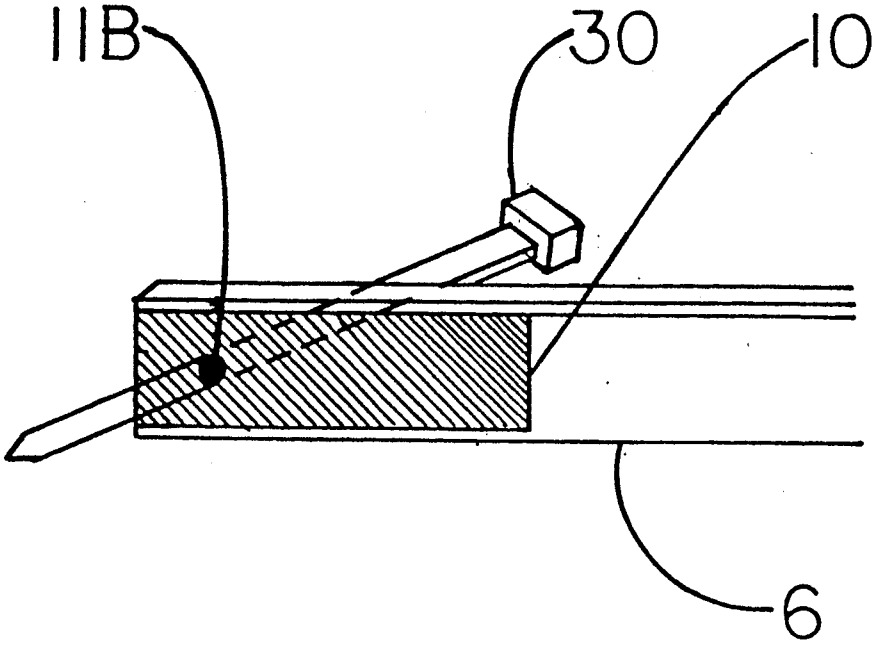
FIG. 4 schematically illustrates one example of a cable tie employed in one example of the invention.

Referring now to FIG. 4, one example of the theft deterrent device of the invention is shown schematically. The theft deterrent device may advantageously comprise a plastic cable tie 30 which is inserted through holes 11A and 11B of mating pieces 10 on strap 6 which may be the upper or lower strap. It will be understood that the theft deterrent device may be used on both the upper and lower straps or may be, at the option of the user, left off. When the theft deterrent device has been inserted through holes 11A and 11B it is fastened in a well known manner. The cable tie 30 may be any commercially available plastic cable tie of the type that may be easily fastened together in a loop such that the loop cannot be easily broken without the use of scissors or other sharp implements. Such devices are well known.

In order to further explain the invention, a method of making an envelope incorporating the features of the invention is explained in detail hereinbelow. It will be understood that other methods of manufacturing such an envelope are also possible and that the description herein is meant by way of illustration and not by way of limitation of the invention.

Figure 5B:
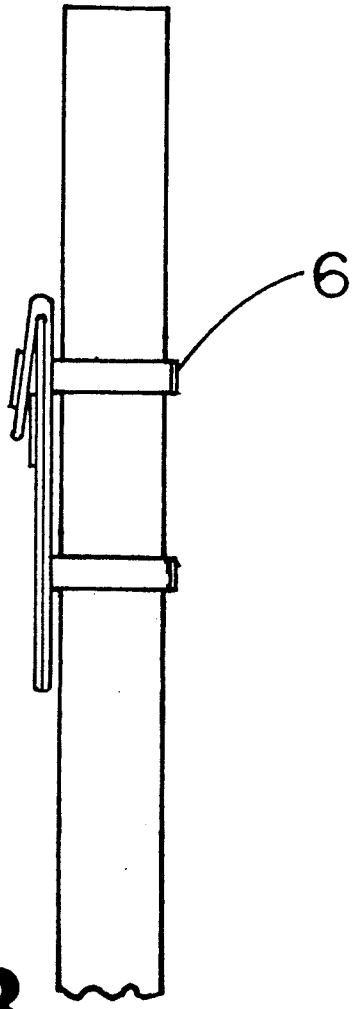
FIGS. 5A and 5B show an envelope of the invention mounted to a sign post.
Figure 5A:
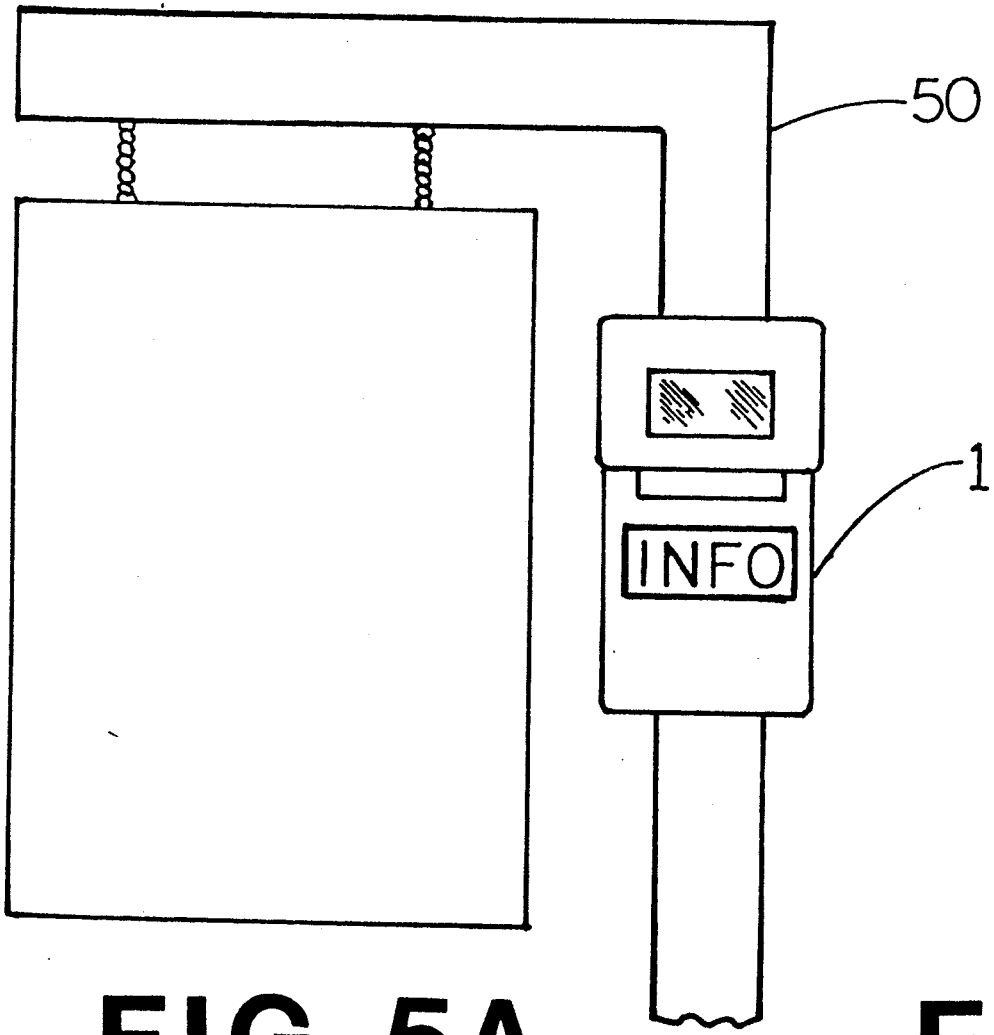

Referring now to FIGS. 1, 2 and 3, the first step in fabricating one embodiment of the invention is to obtain material for the main body of the envelope 1 including the flap 2 and the pocket 3. This material may advantageously be a marine vinyl, resistant to ultraviolet light and resistant to weather including rain and snow. The strips are cut into 27.5 inch pieces of approximately 7 inch width. The strips are then silk screened with any indicia 14 which is desired. In one embodiment of the invention, the silk screen ink is advantageously an ultraviolet resistant ink. Such inks are commercially available. It is desirable to pre-cut the business card window 4 from, for example, a piece of clear vinyl. Similarly, strips of velcro are pre-cut into one inch, two inch and three inch pieces. Polypropylene straps are pre-cut into appropriate lengths as, for example, in the range of 11 inches to 17 inches depending upon the size of the sign post around which the envelope 1 will be mounted as shown in FIGS. 5A and 5B.

In fabricating the envelope the following sewing steps are followed in one example of the method of the invention.

1. The velcro strips 9 and 10 are sewn to the polypropylene straps 6. The ends of the polypropylene straps 6 are advantageously heat-sealed to prevent fraying.

2. The business card pocket and the main pocket are hemmed and a piece of velcro about two inches in length 8 is sewn onto the front of the business card pocket.

3. One end of the main body is hemmed over a seven inch reinforcement strap 62 shown in FIG. 2. It will be understood that this sewing is best done when the main body of the envelope 1 is inside out.

4. The straps 6 are attached to the main body in a suitable location as shown in FIG. 3 with stitching 37.

5. The business card storage pocket is then attached to the main body 1 by stitching 70.

6. The pre-cut vinyl strip is then folded over to create the main pocket 20 and sewn to form the main pocket while inside out.

7. The self-closing flap 2 is then hemmed along stitching lines 66 as shown in FIG. 2.

8. After hemming the self-closing flap 2, a one inch strip 7 of velcro which mates with a complimentary strip 8 is sewn onto the inside of the self-closing flap 2.

9. The clear plastic business card window 4 is sewn to the front of flap 2.

10. The pocket 20 is then turned right-side out for further processing. The self-closing flap 2 is folded over and the seam at the top indicated by stitching 68 as shown in FIG. 1 is done.

11. Drain holes 25, as shown in FIG. 1 may be punched into the bottom of the literature envelope 20.

12. The top and bottom straps 6 are then folded around a simulated sign post 50 such as shown in FIGS. 5A and 5B and the straps are connected by mating pieces 9 and 10 on the top and the bottom so as to align theft deterrent holes 11A and 11B which are located by a heated punch, nail or other similar tool in order to create aligned holes 11A and 11B. This technique makes the hole and seals it in one step.

13. Both plastic pockets are inserted and appropriate advertising materials and/or business cards may also be inserted therein. The plastic pockets may be advantageously a formal plastic bag.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. An information storage envelope for holding literature and mounting onto a sign post comprising:

(a) a first pocket having an open top;

(b) a second smaller pocket having an open top attached to the first pocket;

(c) at least first and second straps attached to the first pocket each strap having first and second ends wherein the first and second ends include mating fastening elements and the straps are attached to the first pocket so as to allow fastening of the straps and first pocket snugly about a post;

(d) a flap attached to the top of the first pocket so as to provide closure for the openings of the first and second pockets;

(c) a window attached to the flap wherein the first and second pockets, the flap, and the at least first and second straps are comprised of a weather resistant material; and (f) a theft deterrent means including holes located through the ends of the at least first and second straps wherein the holes are aligned so as to allow insertion of a locking device.

2. The information storage envelope of claim 1 further comprising first and second mating flap fastening elements wherein the first fastening element is attached to the inside of the flap and the second mating fastening element is attached to the second smaller pocket and located so as to be aligned with the first fastening element when the flap is closed.

3. The information storage envelope of claim 1 wherein the locking device comprises a cable tie.

4. The information storage envelope of claim 1 wherein the first pocket further has a bottom portion including at least one drainage hole located in said bottom portion for draining liquid from the first pocket.

5. The information storage envelope of claim 1 wherein the first and second pockets and the flap are comprised of vinyl.

6. The information storage envelope of claim 1 further comprising a first removable plastic bag contained within the first pocket for storing literature.

7. The information storage envelope of claim 6 further comprising a second removable plastic bag contained within the second pocket for storing cards.

8. The information storage envelope of claim 1 wherein the straps comprise polypropylene material.

9. The information storage envelope of claim 1 wherein the first pocket includes indicia silkscreened thereon.

10. The information storage envelope of claim 9 wherein the indicia is comprised of an ultraviolet-resistant ink.

11. The information storage envelope of claim 1 wherein the flap is attached to the top of the first pocket so as to gravitationally self close when the information storage envelope is mounted onto a post.

12. The information storage envelope of claim 1 wherein the mating fastening elements comprise hook and loop material fasteners.

13. An information storage envelope for holding literature and mounting onto a sign post comprising:

a. a first pocket having an open top and a drainage means;

b. a second smaller pocket having an open top attached to the first pocket;

c. at least first and second straps attached to the first pocket each strap having first and second ends wherein the first and second ends include mating fastening elements and the straps are attached to the first pocket so as to allow fastening of the straps and first pocket snugly about a post;

d. a flap attached to the top of the first pocket so as to provide closure for the openings of the first and second pockets and further comprising first and second mating flap fastening elements wherein the first fastening element is attached to the inside of the flap and the second mating fastening element is attached to the second smaller pocket and located so as to be aligned with the first fastening element when the flap is closed and wherein the flap is attached to the top of the first pocket so as to gravitationally self close when the information storage envelope is mounted onto a post;

e. a window attached to the flap wherein the first and second pockets, the flap, and the at least first and second straps are comprised of a weather resistant material;

f. a theft deterrent means including holes located through the ends of the at least first and second straps wherein the holes are aligned so as to allow insertion of a locking device;

g. a first removable bag sized to be inserted into the first pocket for storing literature; and h. a second removable bag sized to be inserted into the second pocket for storing cards.

14. The information storage envelope of claim 13 wherein the locking device comprises a cable tie.

15. The information storage envelope of claim 13 wherein the first and second pockets and the flap are comprised of vinyl.

16. The information storage envelope of claim 13 wherein the straps comprise polypropylene material.

17. The information envelope of claim 13 wherein the first pocket includes indicia silkscreened thereon.

18. The information storage envelope of claim 17 wherein the indicia is comprised of an ultraviolet-resistant ink.

* * * * *